US006120718A

United States Patent [19]

Kotek et al.

[11] Patent Number: 6,120,718

[45] Date of Patent: Sep. 19, 2000

[54] PROCESS OF MAKING HOLLOW FILAMENTS

[75] Inventors: Richard Kotek, Arden, N.C.; Wei Li, Easley, S.C.; Gary W. Shore, Asheville, N.C.; Ling Yeh, Anderson, S.C.

[73] Assignee: BASF Corporation, Mt. Olive, N.J.

[21] Appl. No.: 09/365,376

[22] Filed: Jul. 30, 1999

Related U.S. Application Data

[60] Provisional application No. 60/094,915, Jul. 31, 1998.

[51] Int. Cl.[7] ..... D01D 5/24; D01D 5/253; D01F 1/08

[52] U.S. Cl. ..... 264/209.1; 264/177.14; 264/211

[58] Field of Search ..... 264/177.14, 209.1, 264/211

[56] References Cited

U.S. PATENT DOCUMENTS

| | | | |
|---|---|---|---|
| 4,477,614 | 10/1984 | Dexter et al. | 524/91 |
| 4,629,752 | 12/1986 | Layer et al. | 524/100 |
| 4,929,653 | 5/1990 | Kletecka et al. | 524/96 |
| 5,208,107 | 5/1993 | Yeh et al. | 428/397 |
| 5,300,583 | 4/1994 | Foa et al. | 525/333.2 |
| 5,318,738 | 6/1994 | Agarwal et al. | 264/177.14 |
| 5,382,633 | 1/1995 | Scott et al. | 525/279 |
| 5,462,802 | 10/1995 | Mikoshiba et al. | 428/376 |
| 5,498,468 | 3/1996 | Blaney | 428/198 |
| 5,679,733 | 10/1997 | Malik et al. | 524/99 |
| 5,688,596 | 11/1997 | Makino et al. | 428/379 |
| 5,705,119 | 1/1998 | Takeuchi et al. | 264/464 |
| 5,719,217 | 2/1998 | Gugumus | 524/100 |

*Primary Examiner*—Leo B. Tentoni

[57] ABSTRACT

A process for producing hollow polyamide filaments having at least one continuous void that adds to a fiber-forming polyamide from about 0.05% to about 5% of a triazine compound prior to extrusion of fiber. The process results in a greater closure of voids and larger void space than when the triazine compound is not used.

10 Claims, No Drawings

PROCESS OF MAKING HOLLOW FILAMENTS

This application claims the benefit of copending U.S. Provisional application Ser. No. 60/094,915 filing date Jul. 31, 1998.

FIELD OF THE INVENTION

The present invention relates generally to synthetic fibers. More particularly, the present invention relates to hollow synthetic fibers and processes for making them.

BACKGROUND OF THE INVENTION

Hollow filaments are known in the fiber market. These hollow fibers provide desirable properties, such as soil hiding, because of one or more continuous axially extending voids running through the filament. Hollow fibers may appear as bulked continuous filaments ("BCF") or staple (i.e., short length) fibers. BCF yarns are, however, becoming a standard of the synthetic fiber industry, due at least in part, to the improved performance and process efficiencies they represent.

Hollow fibers are known in various cross-sections, such as round or multilobal. Trilobal BCF filaments are known and are described in, for example, U.S. Pat. No. 5,208,107 to Yeh et al.

The invention described herein is a hollow fiber (preferably, but not essentially, trilobal BCF) yarn with an increased stable percent void space. "Percent void space" is the cross-sectional area occupied by the void.

When used for carpet applications, high void volume fibers permit carpet mills to use less fiber to produce desired carpet cover resulting in reduced manufacturing cost. Alternatively, the same amount (by weight) of fiber can be used to produce an increased cover product, i.e., an improved product manufactured without increasing the production cost. The size and number of the voids, as well as the cross-section of the filament, determine the properties of the filament, like soil-hiding, bulk, luster, etc. U.S. Pat. No. 5,208,107 to Yeh et al. describes certain hollow trilobal fibers. In order to obtain and maintain consistent, predetermined properties, the characteristics of the voids should be as accurately specified and controlled as possible.

However, the size of the voids (relative to the cross-section of the fiber) is known to decrease during the manufacture of the filaments. The molten filaments emerge from the spinneret with voids of a target size, but once the filaments are quenched, the voids have shrunken. Also, for relatively large void spaces (greater than about 7%), obtaining void space closure is a problem associated with certain spinneret designs, especially those designs that rely on coalescence to achieve the hollow fiber cross-section, such as where three "y" shaped orifices are used to produce a single void hollow trilobal fiber. Various process parameters (polymer temperature, quench rate, polymer viscosity, etc.) can be adjusted to minimize the shrinkage of the void space and, to some degree improve the frequency of void space closure, but these adjustments can be made only by sacrificing the stability of the process. For example, increasing the quench rate by increasing the flow rate of the quench gas can cause the filaments to blow in the air, disturbing the process.

It is known to use additives to reduce void shrinkage. U.S. Pat. No. 5,318,738 to Agarwal et al. describes melt blending an N,N'-dialkyl polycarbonamide with molten fiber-forming polyamide prior to spinning into filaments. The N,N'-dialkyl polycarbonamide is a liquid at common ambient temperatures (e.g., around 25° C.) and requires equipment capable of handling liquids. If such equipment is not already available at the manufacturing site, capital expenditure is required to use the Agarwal additive. It would be advantageous to have a normally solid material that does not require special liquid handling equipment.

It is also known that higher viscosity polymers generally have less void size shrinkage and less unclosed voids than similar polymers of relatively lower viscosity. Increased viscosity polymers are known to present spinning difficulties. Thus, the increase in polymer viscosity only improves void creation performance to a degree before problems are encountered with spinning performance.

A larger void size is desired but is not easy to manufacture because the open void formation during fiber manufacturing. An improved process has been found to overcome these deficiencies.

SUMMARY OF THE INVENTION

It is an object of the present invention to provide an improved process for preventing void shrinkage during the fiber spinning process.

It is another object of the present invention to provide an improved process to promote void closure in the spinning of hollow fibers from segmented spinnerets.

These and other objects are met in a process for producing polyamide filaments having at least one continuous void. The process includes the steps of adding to a fiber-forming polyamide from about 0.05% to about 5% of a triazine compound of the structure:

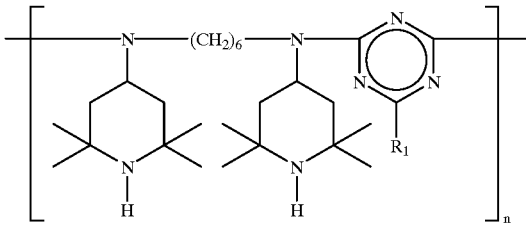

wherein n is an integer from 2 to 20, $R_1$ is NH-tert. octyl, morpholine or NH-cyclohexyl.

This triazine compound is mixed with the fiber-forming polyamide to form a blend that is homogenized and then extruded through a spinneret to form filaments having at least one continuous void, wherein at least about 50% more voids close, and the size of the voids is about 20% larger than when said triazine compound is not mixed with said fiber-forming polyamide.

The process of the present invention may be used to make fibers from any fiber forming polyamide such as nylon 6; nylon 6/6; nylon 6/12;nylon 12;nylon 11; copolymers of these; and blends of these.

DETAILED DESCRIPTION OF THE PREFERRED EMBODIMENTS

To promote an understanding of the principles of the present invention, descriptions of specific embodiments of the invention now follow and specific language is used to describe them. It will nevertheless be understood that no limitation of the scope of the invention is intended by the use of specific language. Alterations, modifications and further applications of the principles of the invention discussed are contemplated as would normally occur to one ordinarily skilled in the art to which the invention pertains.

This invention is a method for producing polyamide filaments (for staple or BCF) having at least one axially extending void. The method greatly reduces the shrinkage of the voids occurring between filament extrusion and quenching. It also improves the overall percentage of closure of voids when segmented spinneret orifices, such as those described in U.S. Pat. No. 5,208,107 to Yeh et al. are used. ("One piece" type spinneret orifices can be used to make hollow fibers, but the void space percentage is typically rather low with such spinneret orifices.) The process increases percent void by at least about 20% and decreases open voids by at least about 50%. As a result, less process interruptions occur and lower fiber manufacturing cost is achieved.

The invention is useful for making any type of polyamide fiber, including multicomponent fibers, such as sheath-core, side-by-side, islands in the sea, etc. Suitable polyamides include nylon 6, nylon 6/6, nylon 6/12, nylon 12, nylon 11, copolymers and blends of these polyamides, as well as any other fiber forming polyamide. The useful polyamides may be used in a variety of molecular weights. Examples include nylon 6 with an RV of 2.4 or nylon 6/nylon 6,6 copolymer with an RV of 3.3 (Ultramid® C35 available from BASF AG, Ludwigshafen, Germany).

In the method of the present invention, at least one oligomeric hydrophilic triazine compound is added to the fiber-forming polyamide prior to extrusion of the filaments. The triazine additive is miscible with the host nylon in the solid and the liquid phase. Although it is preferred to add the triazine compound to molten polyamide, such as in the extruder, it is also possible to add the triazine compound to the solid polyamide, e.g. in the chip form, or use any of the well-known methods to add additives in the fiber spinning process. The additive is added to the fiber-forming polymer, mixed well until homogeneous (i.e., approximately uniformly blended) and extruded into fiber.

The triazine compound has the formula:

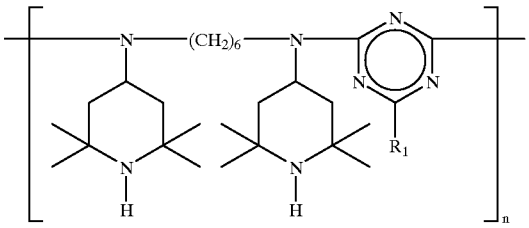

wherein n is an integer from 2 to 20 and $R_1$ is NH-tert octyl, morpholine, or NH-cyclohexyl. Preferred triazine compounds include:

[A]

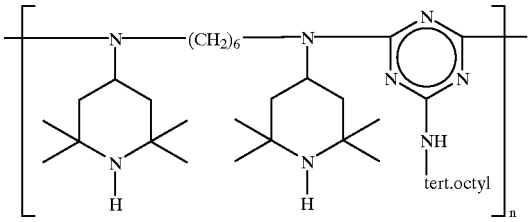

and

[B]

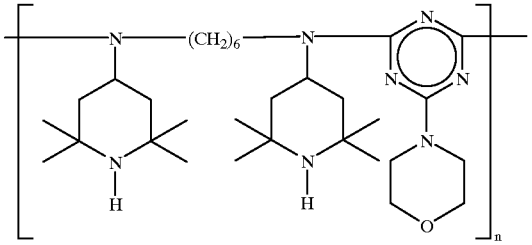

[A] is available from Ciba-Specialty Chemicals, Ardsley, N.Y. as Chimassorb® 944. [B] is available from Cytec, West Patterson, N.J., as Cyasorb® UV3346. The triazine compound is preferably added at from about 0.05% to about 5% by weight of the fiber. More preferably, the triazine will be present at from about 0.1 to 1.5 weight percent of the fiber.

In the process of the present invention, fiber-forming polyamide is homogeneously mixed with the triazine additive. The molten polyamide-additive blend is extruded through a spinneret having orifices designed to make hollow fibers. One preferred spinneret is described in U.S. Pat. No. 5,208,107 to Yeh et al., which is incorporated by reference herein.

In addition to the primary components other additives can be included in the spinning composition. These include, but are not limited to, ultraviolet light stabilizers, antioxidants, pigments, dyes, antistatic agents, soil resists, stain resists, antimicrobial agents, nucleating agents and the like.

Well known techniques for melt spinning hollow fibers can be used in the practice of the present invention. For example, nylon polymer containing an additive may be fed into an extruder, melted and directed via heated polymer distributed line to the spinning head. The polymer melt is metered (preferably, after filtration) to spin pack assembly and extruded through a spinneret with a number of capillaries. The extruded filaments are solidified in a cross flow of chilled air. A finish consisting of lubricating oil and antistatic agents is typically applied to the filament bundle. The filament bundle is preferably drawn, textured and wound-up to form BCF. This process may all take place in what is called in the trade as a "one step" technique of spin-draw-texturing (SDT). A two step technique may also be employed, such as one in which the yarn is extruded and wound-up as an undrawn yarn in a first step, then drawn and textured in a subsequent second step.

The most preferred single filament denier ("denier"—defined as weight in grams of a single filament with the length of 9000 meters) for BCF carpet yarn manufacturing is in the range from about 5 to about 40. Although the most ideal void space percentage depends on the particular trait sought in the fiber for its intended end use, the most preferred void space percentages are from about 6 to about 1.0.

In the following examples, the following techniques are used:

Relative Viscosity

Relative viscosity (RV) is determined with an Ubbelohde™ viscometer at 25° C. by dividing flow time of polymer solution containing one gram of nylon polymer in 100 ml of 96% sulfuric acid by flow time of pure 96% sulfuric acid.

Modification Ratio

The modification ratio (MR) of symmetrical trilobal filament is determined by dividing the radius of largest circumscribed circle by the radius of the inscribed circle.

$TiO_2$ $TiO_2$ content is determined by X-ray fluorescence using a Kevex™ 711 EDX instrument.

Percent Void

Percent void is determined by dividing the cross-sectional area of the void space by the total cross-sectional area of the fiber (including the void space). Ten filaments are measured per sample and the average is reported. Image analysis with a Clemex™ 640 Vision instrument is used to measure the cross sections.

Open Voids

The number of open voids is determined by viewing a BCF cross section (52 filaments) under a microscope and counting the number of filaments exhibiting open voids. The microscope magnification was 118. For example, a value of 3.31 indicates that, on average, 3.31 filaments per bundle of 52 have voids that did not close.

This invention will be described by reference to the following detailed examples. The examples are set forth by way of illustration, and are not intended to limit the scope of the invention. All percentages are by weight unless otherwise indicated.

EXAMPLE 1: COMPARATIVE—TWO STEP PROCESS

Two step nylon 6 hollow trilobal BCF is produced using dry (0.05% water) nylon 6 (RV of 2.72). The nylon 6 chip is fed to an extruder and melted, filtered in the filtration pack and extruded at 264° C. through a spinneret such as described in U.S. Pat. No. 5,208,107, containing 52 capillaries. The extrusion rate is 270 g/min. The extruded molten filaments are quenched with a 180 cfm 0.085 $m^3/s$ cross flow of chilled air and wound up on a package at 816 m/min.

In the second step, the undrawn yarns are drawn about 2.8 times their original length, texturized in a steam medium, and wound up on an appropriate package. The final bulked continuous filament has 52 filaments and a total denier of 1289 (i. e. 24.79 dpf). Filament modification ratio is 2.8. Percent and open void data are reported in Table 1.

EXAMPLE 2: INVENTION—TWO STEP PROCESS 100 parts of dry (0.05% water) nylon 6 with RV of 2.72, 2.94 parts of 17% triazine compound masterbatch having formula [A] (Chimassorb® 944) formulated in nylon 6/nylon 6,6 copolymer (RV=3.3) (Ultramid® C35 available from BASF AG, Ludwigshafen, Germany) and 1 part of 30% $TiO_2$ masterbatch are premixed in a tumbler and converted to BCF as described in Example 1. The final content of $TiO_2$ and Chimassorb 944 in the BCF is correspondingly 0.3 and 0.5%. Percent void and open void data are given in Table 1.

TABLE 1

| TWO STEP PROCESS | | | |
|---|---|---|---|
| Example | % triazine compound | Percent Void | Open Voids* |
| 1 (control) | 0 | 5.40 | 3.31 |
| 2 (invention) | 0.49 | 6.61 | 1.47 |

*average of thirteen packages

EXAMPLE 3: COMPARATIVE—ONE STEP PROCESS

Nylon 6 BCF with a single axial void is prepared using a one-step spin-draw-texture process in the following manner. Dry (0.05% water) nylon 6 chips (RV=2.74) are fed to an extruder and melted. 15% $TiO_2$ master batch is added to the polymer melt at 5.46 g/min using a Colortronic® dry material feeder and thoroughly filtered in the filtration pack prior to the filament extrusion. Hollow filaments are extruded at 262° C. and a rate of 272 g/min. through a spinneret having 52 capillaries, quenched with a cross flow of chilled air and subsequently drawn then textured in hot steam medium to form (BCF). Drawing is conducted at 2400 m/min at 2.8 times of fiber original length. Doff time is ten minutes. The trial is run for 24 hours. Finish on yarn is 1.5% by weigh of fiber. The final BCF has 52 filaments and a total denier of 1240 (i. e. 23.8 dpf). Modification ratio is 2.52. Percent and open void data are reported in Table 2.

EXAMPLE 4: INVENTION—ONE STEP PROCESS 7.94 g/min of 17% triazine compound masterbatch having formula [A] (Chimassorb® 944) formulated in nylon 6/nylon 6,6 copolymer (RV=3.3) is added to the melt of nylon 6 (RV=2.74) via a Colortronic™ dry material feeder and the mixture is processed as described in Example 10. The final content of TiO2 and triazine compound in the BCF is correspondingly 0.3% and 0.5%. Percent and open void data are given in Table 2.

TABLE 2

| ONE STEP PROCESS | | | | |
|---|---|---|---|---|
| Example | % triazine compound | Percent Void | Open Voids | % Full Packages |
| 3 (comparative) | 0 | 4.6 | 0.330* | 89.96 |
| 4 (invention) | 0.48 | 5.9 | 0.125** | 92.37 |

*average of 6
**average of 8

What is claimed is:

1. A process for producing polyamide filaments having at least one continuous void comprising the steps of:

a) adding to a fiber-forming polyamide from about 0.05% to about 5% of a triazine compound of the structure:

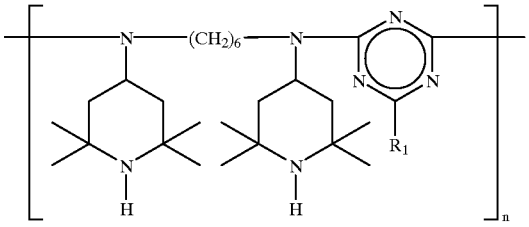

wherein n is an integer from 2 to 20, $R_1$ is NH-tert. octyl, morpholine, or NH-cyclohexyl;

b) mixing said triazine compound with said fiber-forming polyamide to form a blend;

c) homogenizing said blend; and extruding said blend through a spinneret to form filaments having at least one continuous void, wherein at least about 50% more voids close, and the size of the voids is about 20% larger than when said triazine compound is not mixed with said fiber-forming polyamide prior to said extruding.

2. The process of claim 1 wherein said fiber-forming polyamide is selected from the group consisting of:

nylon 6;

nylon 6/6;

nylon 6/12;

nylon 12;

nylon 11;

copolymers of these; and blends of these.

3. The process of claim 1 wherein $R_1$ of the triazine compound is NH-tert. octyl.

4. The process of claim 2 wherein $R_1$ is NH-tert. octyl.

5. The process of claim 1 wherein the triazine compound is added at from about 0.1 to 1.5%.

6. The process of claim 2 wherein the triazine compound is added at from about 0.1 to 1.5%.

7. The process of claim 3 wherein the triazine compound is added at from about 0.1 to 1.5%.

8. The process of claim 4 wherein the triazine compound is added at from about 0.1 to 1.5%.

9. The process of claim 1 wherein the triazine compound is added as a masterbatch in a nylon 6/nylon 6,6 copolymer carrier.

10. The process of claim 9 wherein the carrier has an RV of about 3.3.

* * * * *